United States Patent [19]

Crepinsek

[11] Patent Number: 4,570,471

[45] Date of Patent: Feb. 18, 1986

[54] ENGAGEMENT OF LOCK BODY WITHIN A HOLLOW DOOR-STILE

[76] Inventor: Alois Crepinsek, 97 N. Arizona Pl., Chandler, Ariz. 85224

[21] Appl. No.: 532,919

[22] Filed: Sep. 16, 1983

[51] Int. Cl.[4] ..... E05B 9/08

[52] U.S. Cl. ..... 70/451; 70/461

[58] Field of Search ..... 70/451, 461; 49/503

[56] References Cited

U.S. PATENT DOCUMENTS

| | | | |
|---|---|---|---|
| 2,644,554 | 7/1953 | Katz | 70/451 |
| 3,204,439 | 9/1965 | Eads | 70/451 |
| 3,659,445 | 5/1972 | Eads et al. | 70/451 |
| 3,740,979 | 6/1973 | Crepinsek | 70/451 X |
| 3,899,907 | 8/1975 | Prahl | 70/451 X |

*Primary Examiner*—Robert L. Wolfe

*Attorney, Agent, or Firm*—Robert A. Hirschfeld; James F. Duffy

[57] ABSTRACT

A lock body having compressive engagement with the interior of a hollow structural member of a door, such as a hollow stile. A compressive element is coupled to the lock body by means of a screw fastener. The compressive element has limited rotation about the axis of the screw fastener; the friction of the threaded coupling between the screw fastener and the compression element causing the compression element to rotate about the axis of the screw fastener. Such rotation is limited to approximately 90° by an abutment stop provided on the body of the lock. When the compression element is drawn into abutting contact with the stopping abutment, continued actuation of the screw fastener causes the compression element to traverse the axis of the screw fastener.

7 Claims, 9 Drawing Figures

ENGAGEMENT OF LOCK BODY WITHIN A HOLLOW DOOR-STILE

BACKGROUND

1. Field of the Invention

The invention relates to door locks.

In particular the invention relates to door locks which are mounted interior to a structural element of the door.

More particularly the invention relates to the mounting of a lock body within the hollow stile of a door.

2. Prior Art

In the inventor's earlier U.S. Pat. No. 3,740,979; issued June 26, 1973, the inventor disclosed a door stile lock and latch bolt assembly. In that patent the inventor disclosed a lock body having a general configuration similar that of FIG. 9 herein, which will be discussed in greater detail hereinafter. The lock body of the earlier patent was emplaced within the hollow stile of a door and fastened therein by two bolts which were threaded into bores at the rear of the hollow stile. This prior art mounting arrangement of a lock body within a hollow stile is illustrated in the cross-sectional plan view of the stile in FIG. 1 herein. In FIG. 1 the lock body 10 is maintained in position by means of a threaded fastener 12 which is threaded into threaded bores 13 so as to draw lock body 10 against the rear wall 15 of hollow stile 10 at the compression points labeled C. Because the rear wall 15 of hollow stile 10 was frequently of thin material, such a mounting arrangement did not provide the strength desireable with such an anti-intrusion device. Further, doors utilizing hollow stiles 11 frequently included glass windows 14 which, because of the juxtaposition of the glass 14 with the threaded screw fastener 12 in FIG. 1, would often be damaged by the installation of lock body 10 within stile 11 when screw fastener 12 was threaded into threaded bore 13.

It is an object of the invention to provide the means for engaging a lock body within a hollow stile of a door wherein the resulting engagement will be simple to achieve and provide a strong anti-intrusion mounting for the lock body.

It is a further objective of the invention to provide means for engaging a lock body within the hollow stile of a door in such a manner that there is little or no opportunity for damaging the glass pane carried by the door frame.

It is another objective of the invention to provide means for engaging a lock body within the hollow of a door in manner which requires little effort on the part on the part of the installer and eliminates the need to engage threaded fasteners with unseen threaded bores within the interior of the door stile.

It is an additional objective of the invention to provide means for engaging a lock body within the hollow stile of a door so that minimal alignment of the lock within the hollow stile is required in order to achieve proper engagement.

SUMMARY OF THE INVENTION

The invention represents an improvement in apparatus for engaging a lock body within the interior of a hollow, tubular, structural member of a door, such as a door stile, after the lock body has been passed freely to the interior of the structural member through an opening in that member which is provided there for the passage of the lock body. The improvement comprises screw actuated compression means which are screw-threadedly coupled to the lock body for rotation about the axis of a screw actuating those compression means and for translation along the axis. The improvement further comprises stop means coupled to said lock body for selectedly limiting rotation of the screw actuated compression means to at least one of two rotated positions. One of these rotated positions permits the lock body to be easily passed through the opening in the structural member while the screw actuated compression means is coupled to that lock body. The second position permits compressive engagement of the compression means with the interior of the structural body as the compression means is screw actuated.

In the improvement, the lock body further comprises surface contact means which bear against a first interior surface of the structural member of the door when the screw actuated compression means is actuated into compressive contact with a second interior surface of that structural member. To adapt the lock body for installation within structural members of various interior dimensions, the surface contact means comprise screw adjaustable extensions of the lock body.

The screw actuated compression means of the improvement comprises a U-shaped compression saddle coupled to the lock body by a screw-threaded fastener. The U-shaped compression saddle is rotatable about the axis of the screw-threaded fastener until the compression saddle intercepts the stop means which are coupled to the lock body. When the U-shaped compression saddle so intercepts the stop means it is then translatable along the axis of the screw-threaded fastener as said fastener is rotated about its axis.

Alternatively, the invention may be described as means for compressively engaging a lock within a hollow-tubular-structural member of a door after free passage of the lock to the interior of said structural member through an opening in that structural member which is provided for the such passage of the lock therethrough. These means comprise a lock body having a stopping abutment thereon and a screw fastener coupled to said lock body adjacent to the stopping abutment. Compression means are also provided. The compression means are threadedly coupled to the screw fastener and rotatable about the axis of that screw fastener until the compression means is rotated into interfering contact with the stopping abutment on the lock body. Thereafter the compression means is translatable along the axis of the screw fastener as the screw fastener is rotated about its axis.

The lock body further comprises surface contact means for bearing against the first interior surface of the hollow structural door member into which the lock body is emplaced. This surface contact means is brought into contact with the first interior surface of the structural member when the screw fastener is rotated about its axis so as to translate the compression means along the axis of the screw fastener and into compressive contact with the second interior surface of the structural member. As before, the surface contact means may comprise screw adjustable extensions of the lock body which are adjustable so as to adapt the lock body for emplacement within structural members of various interior dimensions.

In this alternative embodiment, the compression means comprises a U-shaped saddle having two legs which, by actuation of the screw fastener, are drawn into compressive contact with a first interior surface of the hollow structural door member.

DETAILS OF THE INVENTION

Figure 1:
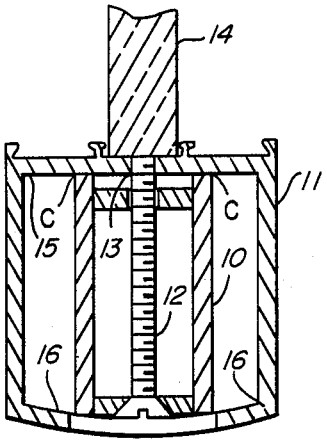
FIG. 1 (PRIOR ART)
FIG. 1 is a sectional plan drawing of a prior art arrangement for engaging a lock body within the hollow stile of a door.

For the purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

As noted in the prior art discussion, FIG. 1 presents a cross-sectional view of a lock body 10 emplaced within a hollow stile 11. Screw fastener 12 is threaded into threaded bore 13 in the rear wall 15 of stile 11. Actuation of screw fastener 12 draws lock body 10 into compressive contact with wall 15 of stile 11 at the points indicated by references C. As earlier noted in the Prior Art discussion there was a tendency for screw fastener 12 to come into interfering contact with a glass pane 14 and damage the glass pane. So too the amount of wall 15 on stile 11 was thin enough so that the strength of the assembly was called into question.

Although the illustration of FIG. 9 will be discussed in greater detail hereinafter reference will now be made thereto to achieve an understanding of the overall aspects of the lock body 10 and the arrangements of the compression means employed for engaging the lock body within a hollow structural member of a door such as a door stile.

Figure 2:
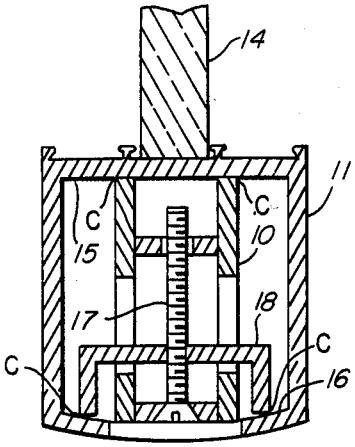
FIG. 2 is a sectional plan drawing of a lock body in compressive engagement with the interior of a hollow stile of a door in accordance with the invention disclosed herein.

The manner in which a lock body 10 is compressively engaged within a hollow structural door member such as stile 11 is illustrated in cross section in FIG. 2. A screw fastener 17 is threadedly coupled to a U-shaped compression saddle 18. The head of screw fastener 17 is in interfering contact with a portion of lock body 10. In the illustration of FIG. 2, when screw fastener 17 is actuated in the conventional right-handed manner, compression means 18 is drawn forward into compressive contact with the inner wall 16 of stile 11. The compressive points of contact are indicated by the reference letter C. With compression means 18 so drawn into compressive contact with surface 16, the interfering relationship of the head of screw fastener 17 brings lock body 10 into compressive contact with the interior surface 15 of stile 11, the compressive points of contact again being indicated by the letter C. With compression at all points C, lock body 10 is rigidly engaged within the interior of stile 11.

Figure 3:
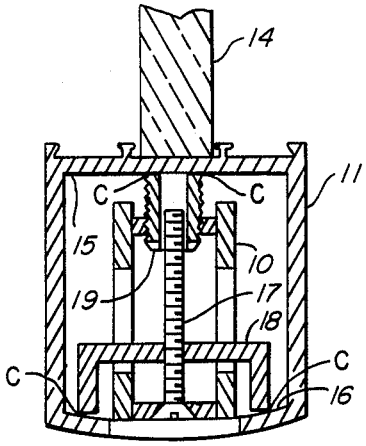
FIG. 3 is an alternative embodiment of the method of engaging a lock body within a hollow stile wherein a screw adjustable contact permits the lock body to be adapted for installation within stiles of various dimensions.

In the embodiment of FIG. 2, lock body 10 has been designed to fit the particular interior dimensions of stile 11. In FIG. 3 is shown an alternative embodiment in which lock body 10 may be adapted for installation within hollow stiles 11 of various interior dimensions. In FIG. 3, lock body 10 is provided with threaded extensions 19. Threaded extensions 19 are adjusted prior to installation of lock body 10 within stile 11. The adjustment provides for the making of a compressive contact at points C on wall 15 of stile 11 when screw fastener 17 is actuated to draw compressive means 18 into contact with wall 16 of stile 11, again at the points indicated by the letter C. By use of lock body extensions 19, a common sized lock body 10 may be adapted for installation into stiles 11 of various dimensions.

Figure 4:
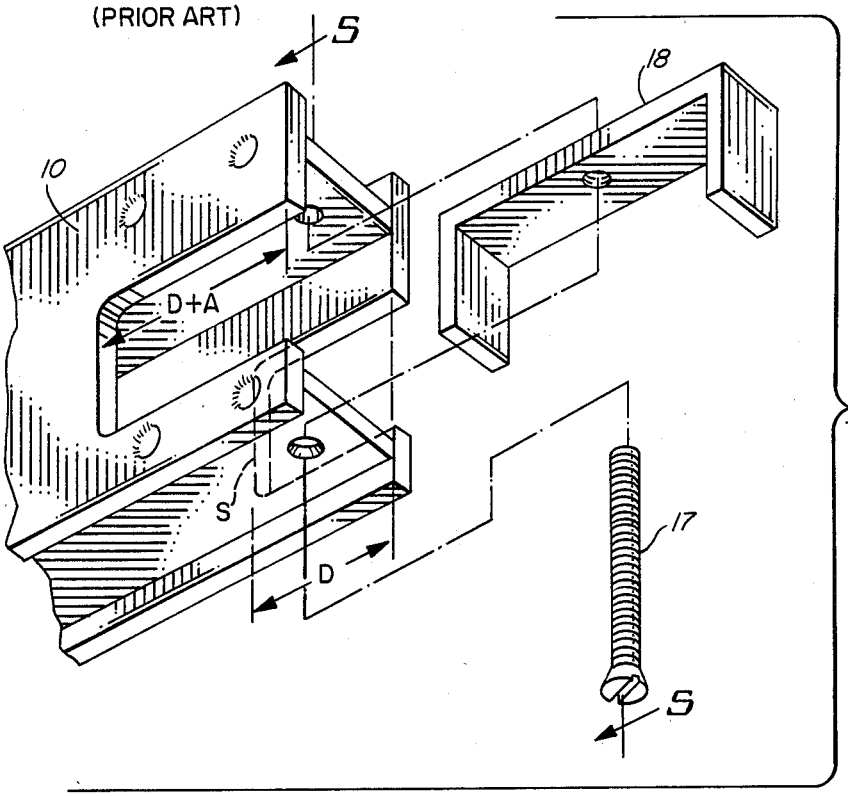
FIG. 4 is a perspective drawing illustrating the manner in which he U-shaped saddle compressive means is installed within the lock body by means of a screw fastener along the axis of which screw fastener the compressive means is rotated and translated.

The illustration of FIG. 4 is an exploded perspective view of one end of the lock body 10. In a first wall of lock body 10 an opening of width D is provided. In a second wall of lock body 10 an opening of width D+A is provided. This second opening is greater than the first opening D by A inches. The selection of this differential measurement A will be determined as hereinafter disclosed. A U-shaped saddle compression means is coupled to lock body 10 by means of screw fastener 17. Screw fastener is freely coupled to lock body 10 through the bores indicated and thread coupled to compression means 18 by means of the threaded bore illustrated.

In the illustration of FIG. 4, compression means 18 is indicated as being installed within lock body 10 such that the longitudinal axis of lock body 10 is substantially parallel with the longitudinal axis of compression means 18. The differential dimension A is selected to permit compression means 18 to rotate about the axis of screw fastener 17 so as to pass through the opening of width D+A in the wall of lock body 10. The width of the opening D is too small (by a dimension A) to permit the full rotation of compression means 18 about the axis of screw fastener 17. Thus, the limitation on rotation of compression means 18 about screw fastener 17, produced by the limited width the opening of dimension D, provides a stop means S for so limiting such rotation.

Figure 5:
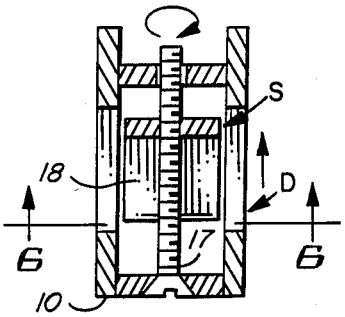
FIG. 5 is a sectional view along line 5—5 of FIG. 4 showing the position at which the saddle shaped compression means is emplaced for installation or removal from the hollow stile of the door.
Figure 6:
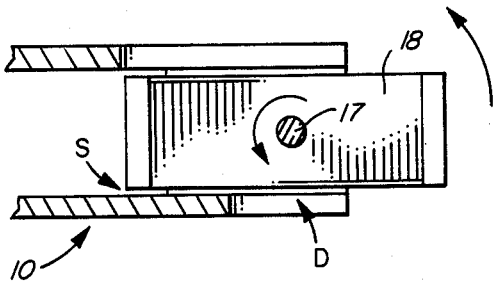
FIG. 6 is a sectional view taken along line 6—6 of FIG. 5.

FIG. 5 is a cross-sectional view taken along lines 5—5 of FIG. 4 wherein the compression means 18 is installed within lock body 10 with the longitudinal axes of the lock body 10 and compression means 18 substantially aligned. FIG. 6 is a cross sectional view along line 6—6 of FIG. 5. When screw fastener 17 is rotated in the direction indicated by the curved arrow about screw fastener 17, the friction of the threaded contacts coupling screw fastener 17 to compression means 18 causes compression means 18 to rotate about the axis of screw fastener 17 until it is brought into interfering contact with stopping means S provided by a foreshortening of the opening of D width. When compression means 18 is aligned in the manner indicated in FIGS. 4, 5 and 6 it may be readily emplaced within or removed from the hollow stile 11 of FIGS. 2 or 3.

Figure 7:
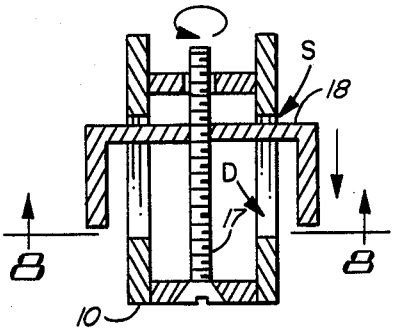
FIG. 7 is a sectional view similar to that of FIG. 5 but here the saddle shaped compression means has been rotated to that position along which it is translatable along the axis of the screw fastener.
Figure 8:
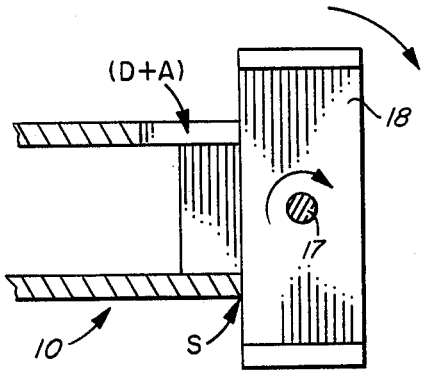
FIG. 8 is a sectional view along line 8—8 of FIG. 7.

When screw fastener 17 is rotated in a direction opposite that indicated in FIGS. 5 and 6, compression means 18 rotates freely through the opening of width D+A. Such rotation of compression means 18 is limited by the stopping means S provided by the foreshortening of the opening of D width. When compression means 18 is brought into abutting contact with stopping means A as illustrated in FIGS. 7 and 8, compression means 18 is positioned to bring compressive means 18 into compressive contact with the interior wall 16 of stile 11 as indicated in FIGS. 2 and 3. As reference to FIGS. 5–8 will indicate, rotation of screw fastener 17 in the conventional clockwise manner will cause the compression means 18, as indicated in FIGS. 2 and 3, to be drawn into compressive contact with wall 16 of stile 11. This, in turn, will bring the lock body 10, or the extension 19 of lock body 10, into compressive contact with the wall 15 of stile 11. Conversely, when the screw fastener 17 is turned anti-clockwise the compressive forces on the walls 15 and 16 of stile 11 will be eliminated and compression means 18 will traverse the axis of screw fastener 17 so as to be drawn away from the interior wall 16 of stile 11. Compressive means 18 will continue to travel along the axis of the anti-clockwise driven screw fastener 17 until it may freely rotate about the axis of screw fastener 17 and pass through the opening of width D+A so as to again align the axes of lock body 10 and compressive means 18; which is the required alignment necessary to install or remove lock body 10 from the interior of stile 11.

As will be obvious to those skilled in the art from the depictations of FIGS. 2 and 3 and FIGS. 5–8 rotation of screw fastener 17 in a clockwise manner will cause the rotation of compression means 18 about the axis of the screw fastener, causing compressive means 18 to pass through the opening of width D+A until brought against the stopping means S provided by the foreshortened opening of dimension D. Compressive means 18 will then traverse the axis of screw fastener 17 until compressive means 18 and lock body 10 or its extension 19, is brought into compressive contact with the interior of stile 11 as indicated at points C of FIGS. 2 or 3.

Figure 9:
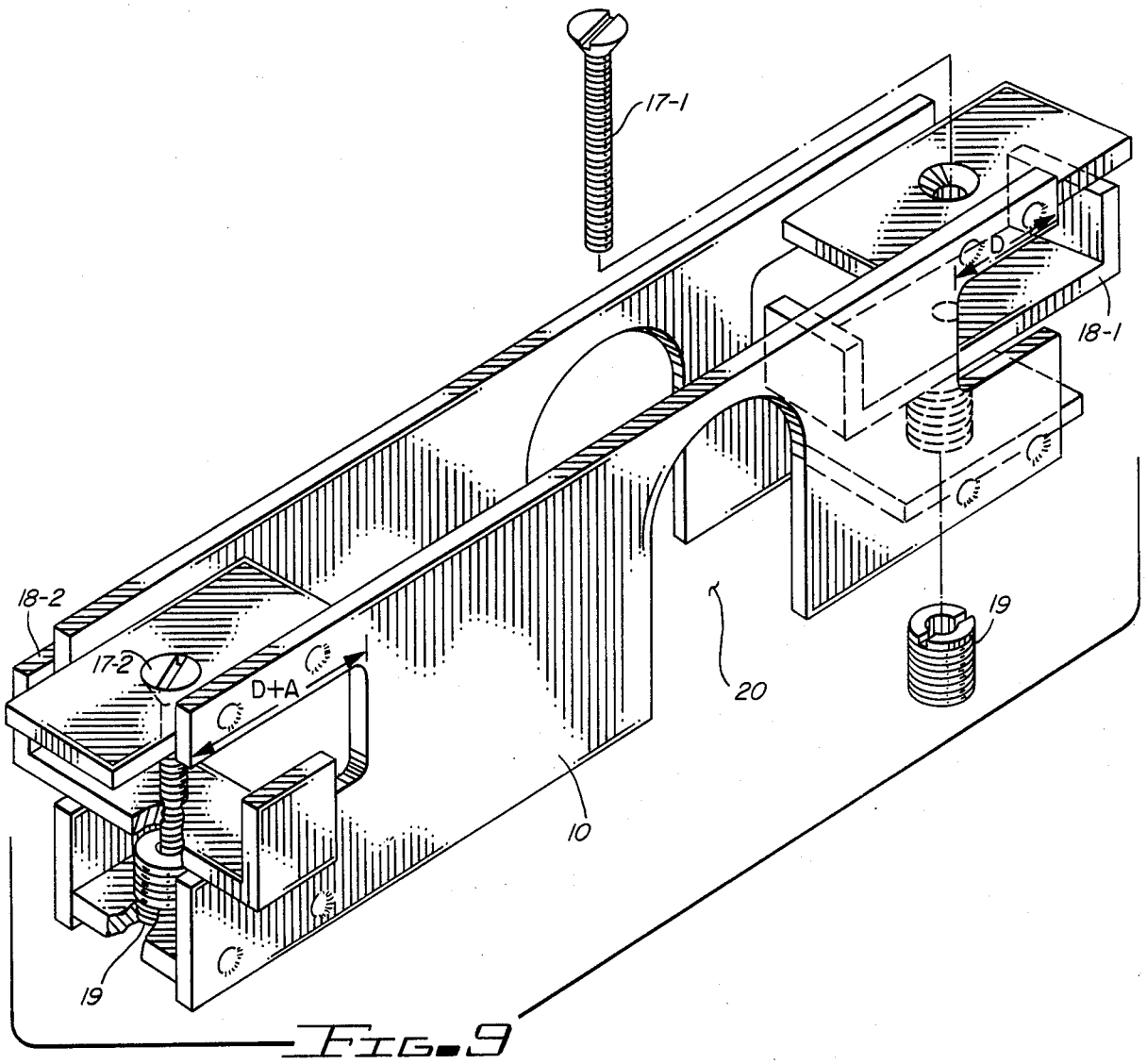
FIG. 9 is a perspective view of the lock body showing a U-shaped compression bracket at each end of the lock body. To the right of the illustration the U-shaped compression means is oriented for emplacing or removing the lock body in or from the hollow stile of the door. When screw 17 is actuated the compression means at the right of the illustration will rotate and assume the position shown by the compression bracket at the left of the illustration. In this position continued actuation of the screw fastener will translate the U-shaped compression means along the axis of the screw fastener.

A perspective depictation of lock body 10 is set forth in FIG. 9. As is shown here, one of compressive means 18, referenced 18-1, has its longitudinal axis in general alignment with the longitudinal axis of lock body 10. A second compression means 18, referenced as 18-2, has its longitudinal axis transverse to the longitudinal axis of lock body 10. Rotation of screw fastener 17-1 in a clockwise manner will cause the rotation of compression means 18-1 so as to place its longitudinal axis transverse the longitudinal axis of lock body 10 in the same configuration as that assumed by compression means 18-2. Clockwise rotation of screw fastener 17-2 will cause compression means 18-2 to traverse the axis of threaded fastener 17-2 and move upwards of the illustration depicted in FIG. 9. Such upward motion of compression means 18-2 will cause the lock body to be brought into compressive engagement with the interior of a stile in which the lock body 10 is emplaced as indicated in FIGS. 2 and 3. Anti-clockwise rotation of screw fastener 17-2 will cause compression means 18-2 to move downward in the depictation of FIG. 9, traversing the axis of screw fastener 17-2 until compression means 18-2 may be freely rotated about the axis of screw fastener 17-2 so as to pass through the opening of width D+A and to assume the same alignment as that indicated for compression means 18-1.

Lock body 10 of FIG. 9 is provided with a cut out opening 20 to accept a lock cylinder housing in the manner disclosed in the inventor's earlier U.S. Pat. No. 3,740,979.

What has been disclosed is a lock body having means thereon for compressive engagement with the interior of a hollow structural member of a door, such as a hollow stile. The compressive means is coupled to the lock body by means of a screw fastener. The compressive means has limited rotation about the axis of the screw fastener, the friction of the threaded coupling between the screw fastener and the compression means causing the compression means to rotate about the axis of the screw fastener. The rotation is limited to approximately 90° by an abutment stop means provided on the body of the lock. When the compression means is drawn into abutting contact with the stopping means, continued actuation of the screw fastener causes the compression means to traverse the axis of the screw fastener.

Those skilled in the art will conceive of other embodiments of the invention which may be drawn from the teachings herein. To the extent that these other embodiments are so drawn it is intended that they shall fall within the ambit of protection provided by the claims appended hereto.

Having disclosed my invention in the foregoing specification and the accompanying drawings in such a clear and concise manner that those skilled in the art may readily understand and easily practice the invention, That which I claim is:

1. An apparatus for engaging a lock body within the interior of a hollow tubular structural member of a door after said lock body has been passed freely to the interior of said structural member through an opening in said member provided for said passage therethrough, the improvement comprising:

screw actuated compression means screw-threadedly coupled to said lock body for rotation about the axis of a screw actuating said compression means and for translation along the same axis;

stop means coupled to said lock body for selectedly limiting rotation of said screw actuated compression means to at least one of two rotated positions, one position permitting ease of passage of said lock body through said opening in said structural member while said screw actuated compression means is coupled to said lock body, and one position permitting compressive engagement of said compression means with the interior of said structural member as said compression means is screw actuated; and surface contact means upon said lock body for bearing against a first interior surface of said structural member when said screw actuated compression means is actuated into compressive contact with a second interior surface of said structural member, wherein said surface contact means comprise screw adjustable extensions of said lock body adjustable for adapting said lock body for installation within structural members of various interior dimensions.

2. The improvement of claim 1 wherein said screw actuated compression means comprises a U-shaped compression saddle coupled to said lock body by a screw-threaded fastener and rotatable about the axis of said screw-threaded fastener until said compression saddle intercepts said stop means and thence being translatable along said axis of said screw-threaded fastener as said fastener is roated about its axis, said lock body further comprises surface contact means for bearing against a first interior surface of said structural member when the legs of of said U-shaped compression saddle are drawn into compressive contact with a second interior surface of said structural member.

3. The improvement of claim 2 wherein said surface contact means comprise screw adjustable extensions of said lock body adjustable for adapting said lock body for installation within structural members of various interior dimensions.

4. Means for compressively engaging a lock within a hollow tubular structural member of a door after free passage of said lock to the interior of said structural member through an opening in said structural member provided for such free passage therethrough, comprising:

a lock body having a stopping abutment thereon and a screw fastener coupled to said lock body adjacent said stopping abutment;

compression means threadedly coupled to said screw fastener and rotatable about the axis of said screw fastener until rotated into interfering contact with said stopping abutment and thence translatable along the axis of said screw fastener as said screw fastener is rotated about its axis; and surface contact means upon said lock body for bearing against a first interior surface of a hollow structural door member, into which said lock body is emplaced, when said screw fastener is rotated about its axis so as to translate said compression means along the axis of said screw fastener and into compressive contact with a second interior surface of the structural member in which said lock is emplaced, wherein said surface contact means comprise screw adjustable extensions of said lock body adjustable for adapting said lock body for emplacement within structural members of various interior dimensions.

5. The means of claim 4 wherein said compression means comprises a U-shaped saddle having two legs which by actuation of said screw fastener are drawn into compressive contact with a first interior surface of a hollow structural door member in which said lock body is emplaced.

6. The means of claim 5 wherein said lock body further comprises surface contact means for bearing against a second interior surface of a hollow structural door member when said legs of said U-shaped saddle are drawn into compressive contact with a first interior surface of the same hollow structural door member.

7. The means of claim 6 wherein said surface contact means comprises screw adjustable extensions of said lock body for adjustably adapting said lock body for emplacement within hollow structural door members of various interior dimensions.

* * * * *